United States Patent [19]

Youtie

[11] Patent Number: 4,773,144

[45] Date of Patent: Sep. 27, 1988

[54] METHOD OF MANUFACTURE OF SCROLL COMPRESSORS AND EXPANDERS

[76] Inventor: Robert K. Youtie, 200 Uxbridge, Cherry Hill, N.J. 08034

[21] Appl. No.: 54,450

[22] Filed: May 27, 1987

Related U.S. Application Data

[63] Continuation-in-part of Ser. No. 767,114, Aug. 19, 1985, Pat. No. 4,677,949.

[51] Int. Cl.[4] ..... B23P 15/00

[52] U.S. Cl. ..... 29/156.4 R; 29/428; 29/460

[58] Field of Search ..... 29/156.4 R, 156.8 K, 29/156.8 CF, DIG. 38, DIG. 48, 428, 460; 418/5, 55, 59; 123/235, 234, 238

[56] References Cited

U.S. PATENT DOCUMENTS 4,550,480 11/1985 Tanikawa et al. ..... 29/156.4 R
4,615,091 10/1986 Nuva et al. ..... 29/156.4 R
4,690,625 9/1987 Murayama et al. ..... 29/156.4 R
4,696,084 9/1987 Hirano et al. ..... 29/156.4 R
4,720,899 1/1988 Ando et al. ..... 29/156.4 R

FOREIGN PATENT DOCUMENTS 0135291 8/1982 Japan ..... 29/156.4 R
0208186 11/1984 Japan ..... 29/156.4 R
0233389 11/1985 Japan ..... 29/156.4 R

*Primary Examiner*—P. W. Echols
*Assistant Examiner*—Irene Cuda
*Attorney, Agent, or Firm*—Robert K. Youtie

[57] ABSTRACT

The disclosure concerns a method of manufacturing scroll expander and a scroll compressor including winding together strips of different width so that the wider strip forms a scroll or spiral and the narrower strip partially occupies the inter-convolution spaces of the wider strip.

9 Claims, 3 Drawing Sheets

METHOD OF MANUFACTURE OF SCROLL COMPRESSORS AND EXPANDERSCROSS-REFERENCES TO RELATED APPLICATIONS

This application is a continuation-in-part of my copending U.S. patent application Ser. No. 767,114, filed Aug. 19, 1985, now U.S. Pat. No. 4,677,949.

BACKGROUND OF THE INVENTION

Examples of the prior art of scroll-type fluid displacement apparatus are disclosed in the below listed patents:

| | Patentee |
|---|---|
| U.S. Pat. No. | |
| 801,182 | Creux |
| 3,817,664 | Bennett et al |
| 3,884,599 | Young et al |
| 3,994,635 | McCullough |
| 4,129,405 | McCullough |
| 4,192,152 | Armstrong et al |
| 4,300,875 | Fischer et al |
| 4,343,599 | Kousokabe |
| 4,484,869 | Nakayama et al |
| 4,490,099 | Terrauchi et al |
| 4,497,615 | Griffith |
| 4,505,651 | Terrauchi et al |
| 4,515,539 | Morishita |
| 4,550,480 | Tanikawa et al |
| 4,553,913 | Morishita et al |
| French Patent No. | |
| 836,142 | Lasnier |

The prior art discloses scroll apparatus employed to pump and compress fluids, and also as motors or engines driven by fluids. However, the prior art makes no suggestion of a scroll apparatus as an internal combustion engine.

A scroll apparatus may be considered as spiral wraps interfitting in a tangential relation to define a pocket between the wraps and relatively orbital to move the pocket and enlarge or reduce its size according to the direction of orbital movement.

SUMMARY OF THE INVENTION

Other objects of the present invention will become apparent upon reading the following specification and referring to the accompanying drawings, which form a material part of this disclosure.

The invention accordingly consists in the features of construction, combinations of elements and arrangements of parts, which will be exemplified in the construction hereinafter described, and of which the scope will be indicated by the appended claims.

DESCRIPTION OF THE PREFERRED EMBODIMENT

Figures 1, 3A:
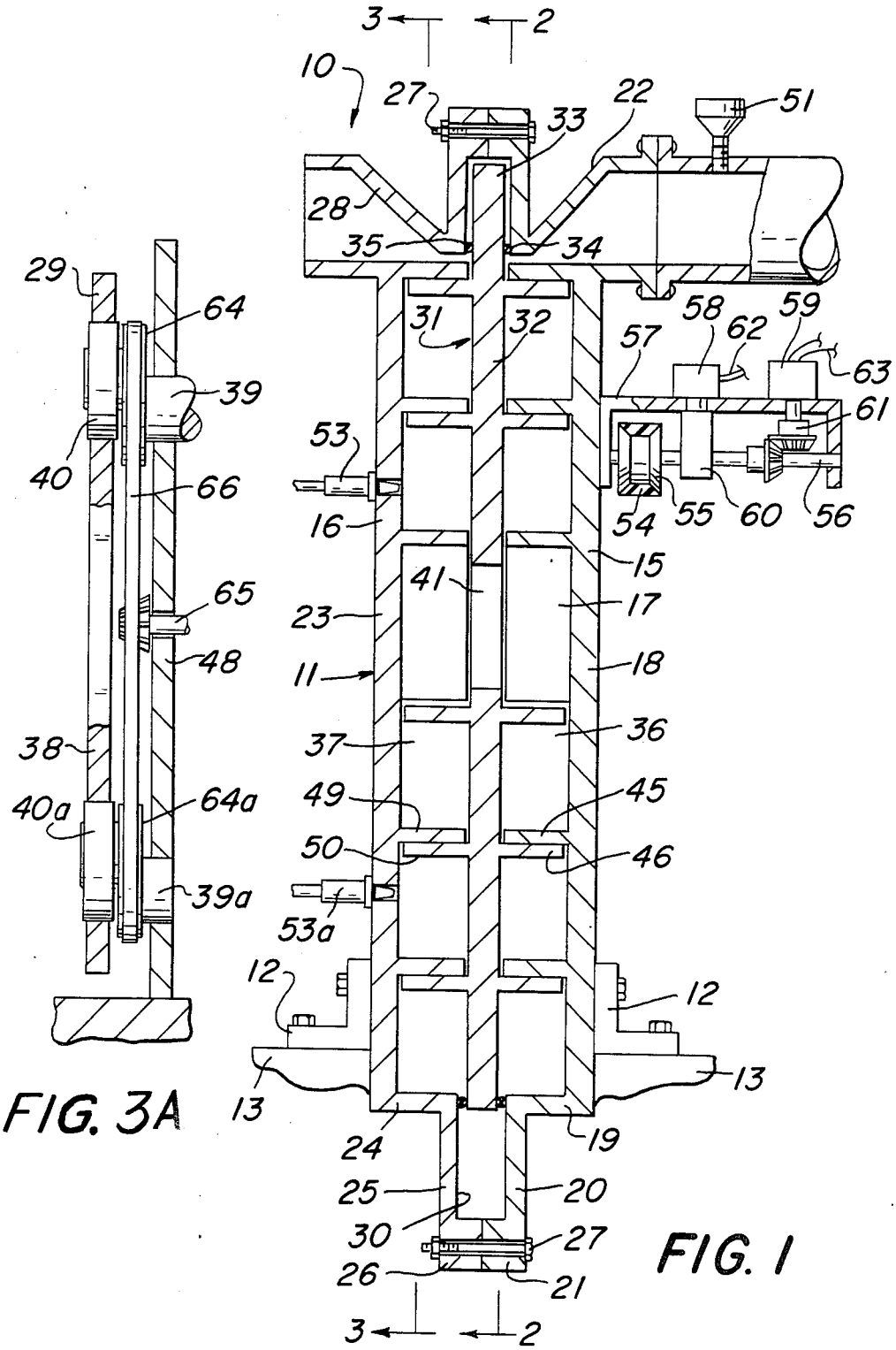
FIG. 1 is a transverse sectional view showing a scroll type apparatus constructed in accordance with teachings of the present invention.
FIG. 3A is a sectional view taken generally along the line 3A—3A of FIG. 2
Figure 2:
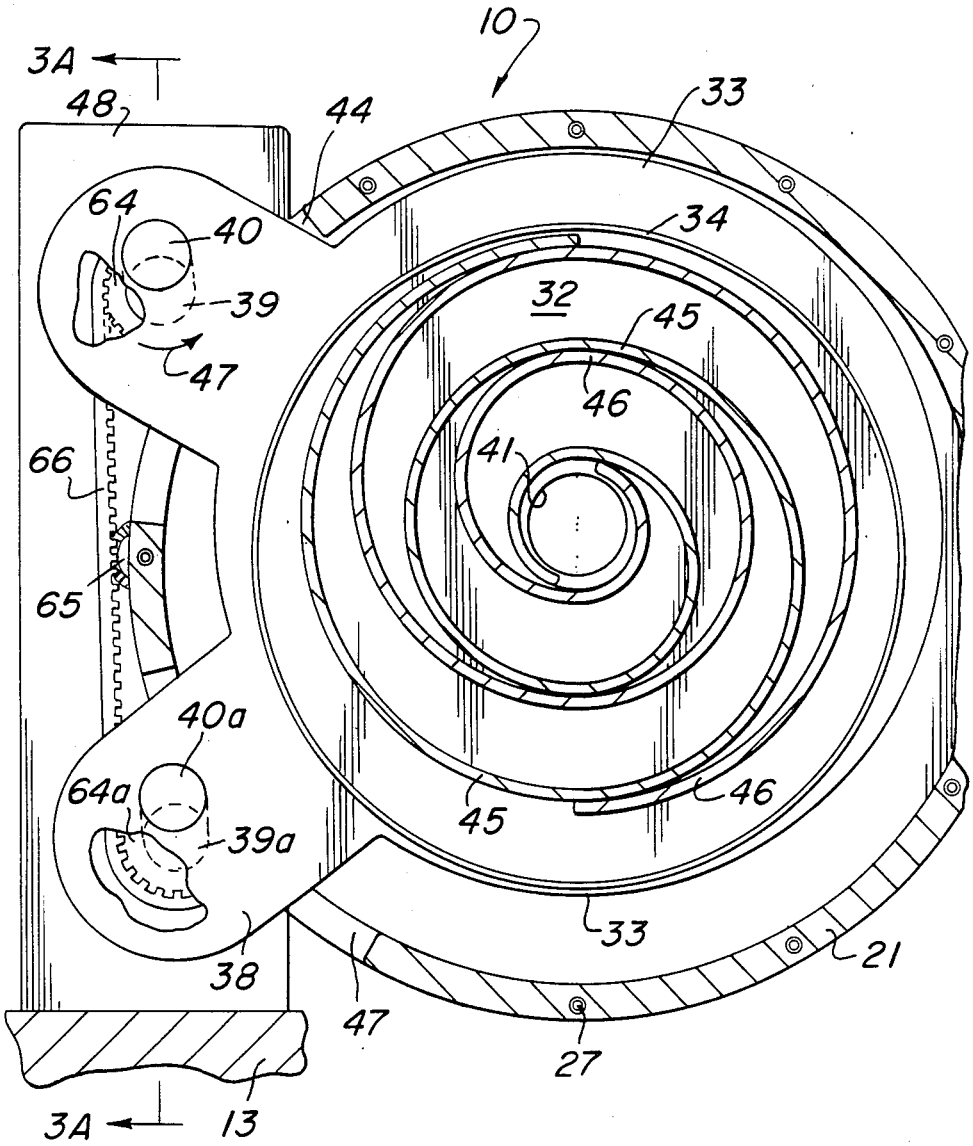
FIG. 2 is a sectional view taken generally along the line 2—2 of FIG. 1.

Referring now more particularly to the drawings, and specifically to FIGS. 1 and 2, an internal combustion engine is there generally designated 10 and may include a casing 11 suitably fixed, as by brackets 12 to a support 13. The casing 11 may include a pair of complementary casing sections 15 and 16 which may each be generally cylindrical in facing, spaced relation with each other to define a generally closed cylinder enclosing a generally cylindrical interior space 17. More specifically, the casing section 15 may include a generally flat, circular side wall 18 having an inwardly extending peripheral wall 19. Extending along the inner edge of the peripheral wall 19 is a flange 20, radially outstanding beyond the peripheral wall, and provided on its outer edge with an in-turned securement lip 21. At one location about the periphery of the side wall 15, the peripheral wall 19 is provided with an air inlet conduit 22 communicating between the exterior and interior of the casing 11. The side wall 23 of casing 16 is essentially similar to the casing side wall 18 being generally flat and of circular configuration, having a peripheral, inwardly extending wall 24 provided on its inner edge with a circumferentially radially outstanding flange 25. The radially outer edge of the flange 25 is provided with a circumferentially extending, inturned securement lip 26 in edge to edge relation with the securement lip 21 of the casing section 15. The casing lips or securement edges 21 and 26 may be suitably secured, as by a circular array of bolts or fasteners 27, and suitably sealed, as by desired gasket means.

At one location about the peripheral wall 24 of the casing section 16 there may be provided a fluid outlet or exhaust conduit 28 communicating between the interior space 17 of the casing 11 and the exterior thereof.

The generally annular flanges 20 and 25 extend in facing, spaced relation with each other and combine with their inturned lips 21 and 26 to define an annular channel or groove 30 extending generally circumferentially about the cylindrically shaped casing 11 and opening radially into the interior hollow 17 of the casing. The annular channel or groove 30 opens radially outwardly, as by interruptions 44 and 47 in the securement edges or flanges 21 and 26, for purposes appearing presently.

A rotor is generally designated 31 and located interiorly of the casing 11. The rotor may include a generally flat, approximately circular plate 32 having its circumferential margin 33 extending into the channel 30 entirely thereabout. That is, the marginal edge portion 33 of the rotor plate or wall 32 extends into the circumferential casing groove or channel 30 entirely thereabout, terminating short of the channel lips 21 and 26 to permit of orbital movement of the rotor by rotary translation in the manner of scroll type apparatus.

A description of scroll apparatus construction may be obtained from prior art patents, such as U.S. Pat. No. 4,490,099 to Terrauchi et al and 4,343,599 to Kousokabe.

The generally circular plate or rotor 32 may be provided with a pair of angularly spaced, generally radial extensions, as at 29 and 38, respectively extending through openings 44 and 47 formed in the meeting edge flanges 21 and 26.

As noted, the rotor plate or wall 32 moves in a circular, translational orbit extending into the groove 30; and, suitable sealing means, such as O-rings or gaskets 34 and 35 may be interposed between the rotor plate 32 and channel walls 20 and 25, respectively. Thus, the rotor plate 32 may subdivide the interior 17 of the casing 11 into a pair of chambers 36 and 37 in side-by-side relation on opposite sides of the rotor. The chamber 36 may be considered as the inlet or compression chamber, while the chamber 37 may be considered as the outlet or expansion chamber.

A pair of crank shafts 39 and **39*a* are suitably journalled, in generally parallel relation, in a fixed support 48, each shaft including an eccentric or crank, as at 40 and 40*a*, respectively. The eccentrics 40 and 40*a* are journalled in and extend rotatably through respective rotor extensions 29 and 38. Transmission means, such as toothed wheels 64 and 64*a* may be keyed to respective shafts 39 and 39*a*, and suitably geared together as by a chain or belt 66. Thus, rotation of one of the shafts 39, 39*a* will rotate the other in timed relation to effect the circular translatory orbital movement of rotor 31**, as in scroll apparatus.

Other suitable means may be provided for constraining the rotor to its orbital motion.

In scroll-type fluid displacement apparatus there are included a pair of generally identical spiral walls or wraps interfitting with each other and combining with each other and end plates or closures to define closed pockets which move spirally and radially upon relative orbital movement between the spiral wraps. In particular, a pair of diametrically opposed, closed pockets move radially and spirally inwardly and reduce in size to effect compression of fluid in the pockets, see for example U.S. Pat. No. 4,490,099, FIGS. **1*a* through 1*d***. Upon reversed circular translatory orbitting, the diametrically opposed pockets move radially and spirally outwardly and increase in size for expansion of the fluid contents. This reversal of compression to expansion may be effected also by providing spiral wraps of opposite angular direction, while retaining orbital movement of the same direction as for compression.

Further, it will be understood that, as from U.S. Pat. No. 4,490,099, the opposed, closed pockets of reducing size are closed or out of communication with each other, until the fluid arrives in a substantially compressed condition, that of FIG. **1*d***, when the opposed pockets open to or communicate with each other as a single central closed pocket. Conversely, upon expansion the central closed pocket expands into a pair of diametrically opposed, closed expanding pockets moving radially and spirally outwardly. The pair of opposed pockets are closed and out of communication with the central opening or passageway, while the central pocket opens or communicates through the central passageway, as will appear more fully hereinafter.

Fixed on the internal surface of casing wall or end plate 18 is a spiral compression wrap or wall 45 of somewhat more than two convolutions. An identical spiral wrap or wall 46 is fixed to and outstands from the rotor wall or end plate 32 into the compression chamber 36, being angularly off-set approximately 180° from the wrap 45 and radially off-set by the eccentric distrance of cranks 40 and **40*a*. This may be seen in FIG. 2 where it will be appreciated that rotation of the crank shafts 39 and 39*a* in the counterclockwise direction of arrow 47 to orbit the movable spiral wrap 46 counterclockwise, will result in the drawing of fluid inwardly through inlet passageway 22 into the radially outer regions of chamber 36 and thence by size reduction of the opposed pockets centrally to a central pocket. A central aperture or passageway 41 is formed in the rotor wall or plate 32 through which compressed fluid in the central pocket may exit into the central region of the expansion chamber 37**.

Thus, it will be appreciated that the fixed and orbital wraps 45 and 46 may be considered compression wraps, and combine with the casing wall 18 and rotor wall 32 to define a compressor.

Figure 3:
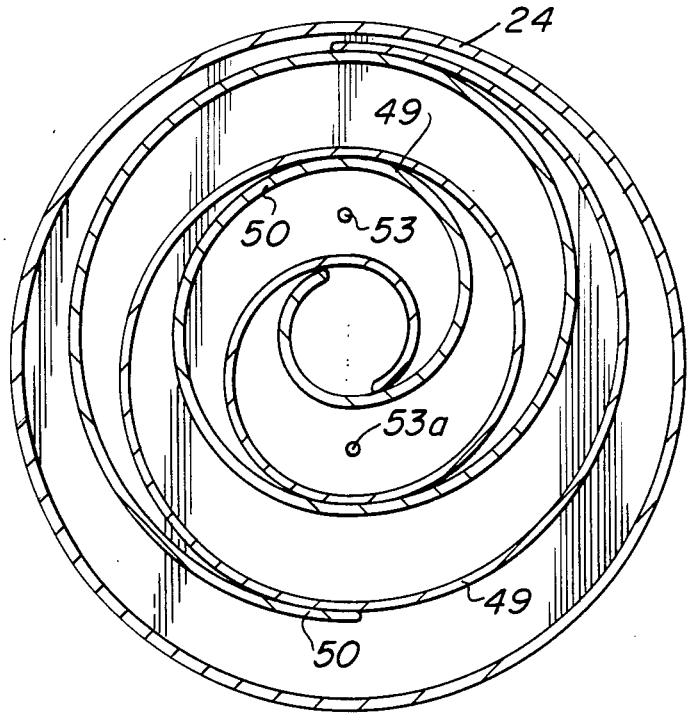
FIG. 3 is a sectional view taken generally along the line 3—3 of FIG. 1.

Extending into chamber 37 from casing end plate or wall 23, and fixed thereto, is a spiral wall wrap 49, see FIG. 3. A similarly oriented spiral wall or wrap 50 is provided on and projects from the rotor end plate or wall 32 into the chamber 37. As best seen in FIGS. 2 and 3, the spiral wraps 45 and 46 of chamber 36 are oriented in one angular direction, and the spiral wraps 49 and 50 in the chamber 37 are oriented in the opposite angular direction. Thus, upon rotation of the rotor 31 to effect orbital movement of the movable spiral wraps 46 and 50 in the same angular direction, the cooperating pairs of spiral wraps will cooperate oppositely. As noted hereinbefore, the spiral wraps or walls 45 and 46 will compress fluid radially inwardly. Conversely, the spiral wraps 49 and 50 will expand fluid radially outwardly. Thus, fluid entering chamber 37 through port or passageway 41 will expand and move radially outwardly in chamber 37 for discharge through outlet 28. The spiral wraps 49 and 50 may therefore be aptly termed the fixed and moveable expansion spiral wraps, respectively.

Desireably the fluid or air entering in the conduit 22 may be provided with a lubricant, such as by oil dispenser or oiler 51 to lubricate and minimize wear on the contacting surfaces of the spiral wraps and end plates. Also, fuel may be introduced into the air entering conduit 22, say together with the oil, if desired. Of course, fuel may be introduced at a different location, for example, fuel may be introduced by injection into the compressed air in a central pocket, if desired. If desired, suitable sealing means may be provided, along the edges of the spiral wraps, to further seal the pockets described hereinbefore.

In the expansion chamber 37, at diametrically opposed locations adjacent to but radially outward of the central region, there may be provided a pair of spark plugs, as at 53 and **53*a* in the casing wall 23. Thus, the spark plugs 53 and 53*a* introduce ignition into the pair of closed, diametrically opposed expanding pockets, for combustion and expansion to drive the apparatus. That is, the products of combustion expand in the opposed pockets of the expander to drive the rotor 31, and thereby drive shafts 39 and 39*a* the products of combustion exhausting through the outlet conduit 28**.

An accessory mounting bracket 57 may be provided on a casing wall 18, mounting a transmission gear or wheel 55 driven as by a belt 54 from one of the shafts 39, 39*a* to rotate an accessory shaft 56. The bracket 57 may mount a fuel pump 58 and a distributor 59, which are respectively driven, as by driving means 60 and 61 from the shaft 56. The fuel pump 58 may be connected by conduits 62, say to the fuel feed device 51, or other suitable fuel feed or injector. The distributor 59 may be connected, as by conductors 63 to deliver the spark to plugs 53 and 53*a*, in properly timed relation to effect combustion of charges in expanding, closed diametrically opposed pockets. This maintains operation of the engine 10 and, produces useful work at the shafts 39 and 39*a*.

Suitably mounted, as by fixing to the support 48, may be a starter motor 65, which may be in meshing, driving relation with chain or belt 56 for initiating operation of the engine.

Figure 4:
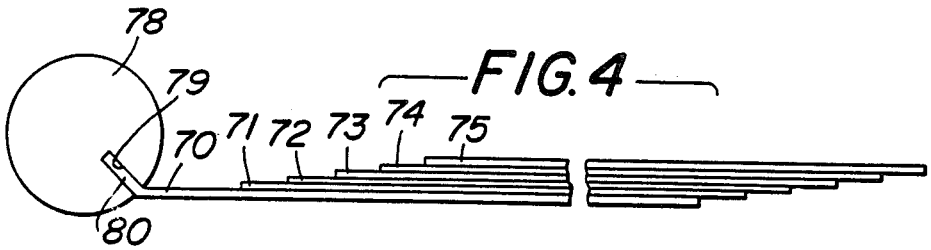
FIG. 4 is an end view illustrating an early stage in manufacture of a scroll element according to the instant invention.
Figure 5:
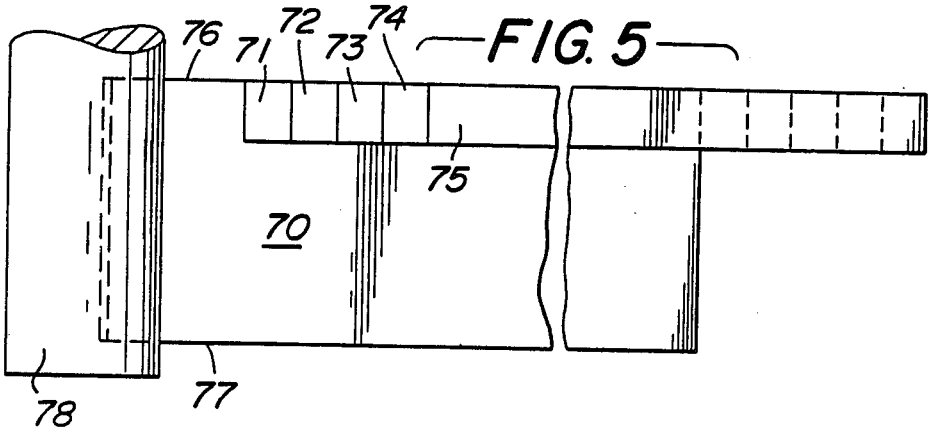
FIG. 5 is a plan view showing the manufacture according to FIG. 4.

In FIGS. 4 and 5 are illustrated an initial stage in manufacture of a scroll element, wherein a plurality of sheets, strips or laminations 70, 71, 72, 73, 74 and 75 are arranged in longitudinally extending relation with each other and are arranged in superposed or overlying, facing engagement. The lowermost, elongate sheet, strip or lamination 70 may be relatively wide, as between opposite side edges 76 and 77, while the remaining elongate strips or laminations 71–75 are of equal, relatively narrow width and superposed one above the other in laterally coextensive relation, all having one side edge extending along and coincident or flush with the side edge 76 of the wider strip 70. The several narrower strips 71–77 may be of generally equal length, and may be superposed one over the other in staggered or stepped relation, each successive upper strip having its leftward end spaced rightward from the leftward end of the next adjacent lower strip. Also, the several narrower strips may be spaced rightward from the leftward end of the lowermost, wider strip 70.

A core, roll or mandrel 78 may be formed with a longitudinally extending, radially outwardly opening slot 79 adapted to receive the leftward, free end portion 80 of the lower most, wider strip 70. This is the condition shown in FIGS. 4 and 5.

Figure 6:
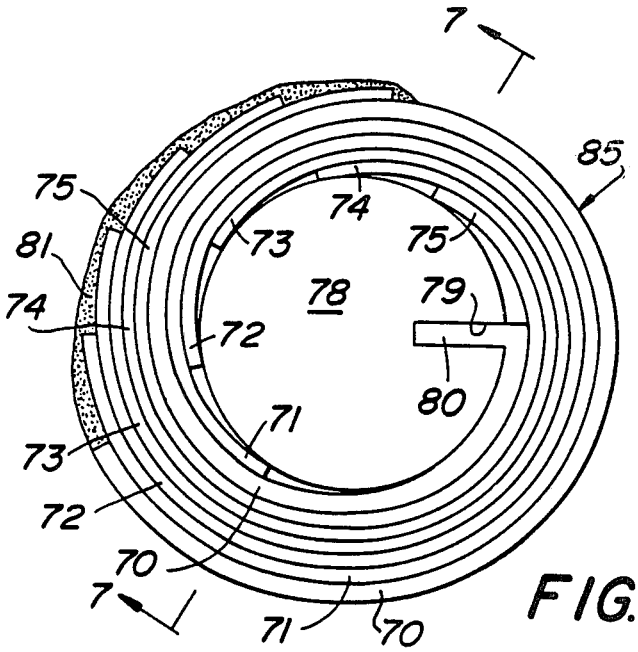
FIG. 6 is an end view showing a later stage in the instant method.

The cylindrical mandrel or core rod 78 may be rotated or rolled, generally clockwise as seen in FIG. 4 to wind the strips 70–75 about the mandrel, as shown in FIG. 6. Thus, the several strips 70–75 are tightly wound about the mandrel, each strip 71–75 having its entire radially outer surface in facing engagement with the next outer strip, except for the radially outer end portions. Also, the relatively wide strip 70 is spirally wound with its radially inner surface along its side edge 76 in intimate facing engagement with the next adjacent narrower strip 71, except for the innermost end region of the wider strip. In such configuration, each strip 70–75 defines a spiral having its adjacent convolutions spaced apart by the remaining strips. In particular, the spiral convolution defined by the wider strip 70 is illustrated as extending angularly approximately 500°, to define a partial second convolution of approximately 140°. The overlapping portions of convolutions of strip 70 are spaced apart a constant distance by the interposed laminations of narrower strips 71–75.

The wound assemblage of FIG. 6 may be fixedly secured together in its wound or spiral configuration by any suitable means, such as a weld 81 on the outer periphery of the spiral winding, say securing together the end portions of the several strips 70–75 to prevent unwinding of the strips.

Figure 7:
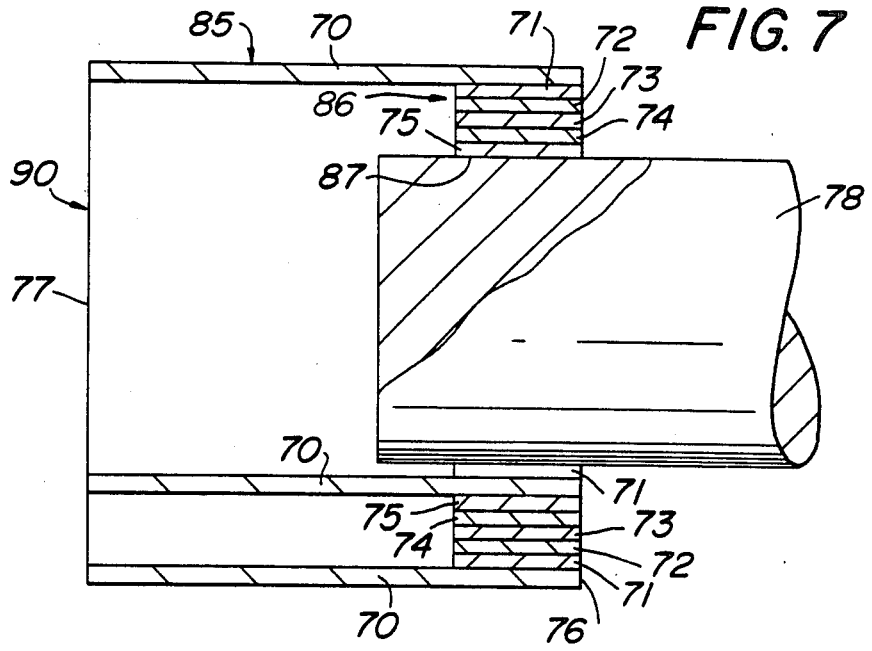
FIG. 7 is a sectional view taken generally along the line 7—7 of FIG. 6.

From FIGS. 6 and 7 it will be understood that a scroll element is provided, generally designated 85, fabricated of the several laminations 70–75 wherein the laminations 71–75 and the adjacent portions of lamination 70 are all in overlying facing engagement with each other having one edge generally coplanar and combine to define an end wall or plate 86 generally normal to and closely surrounding the mandrel or core 78. The mandrel or core 78 may be longitudinally withdrawn for removal to leave a central opening 87, which may be suitably filled or closed, as desired.

The remaining portion of lamination 70 extends beyond the end wall 86 and has its edge 77 generally coplanar and located beyond the strips or layers 71–75 of end wall or plate 86. By this extension of relatively wide strip or sheet 70 beyond the relatively narrow laterally coextensive sheets or strips 71–75, the wider strip 70 defines a spiral wrap 90 outstanding from the end wall 86. A pair of such scroll elements 85 may be arranged with their end walls 86 in parallel spaced, facing relation and their spiral wraps 90 in interfitting relation, and mounted for relative orbital motion to provide a scroll type fluid displacement apparatus.

Of course, the laminations 71–75 may be more or less in number and of any preferred thickness to achieve a desired spacing between convolutions or partial convolutions of the spiral wrap 90. Also, the spiral wrap may be of more than one lamination, if desired.

Figure 8:
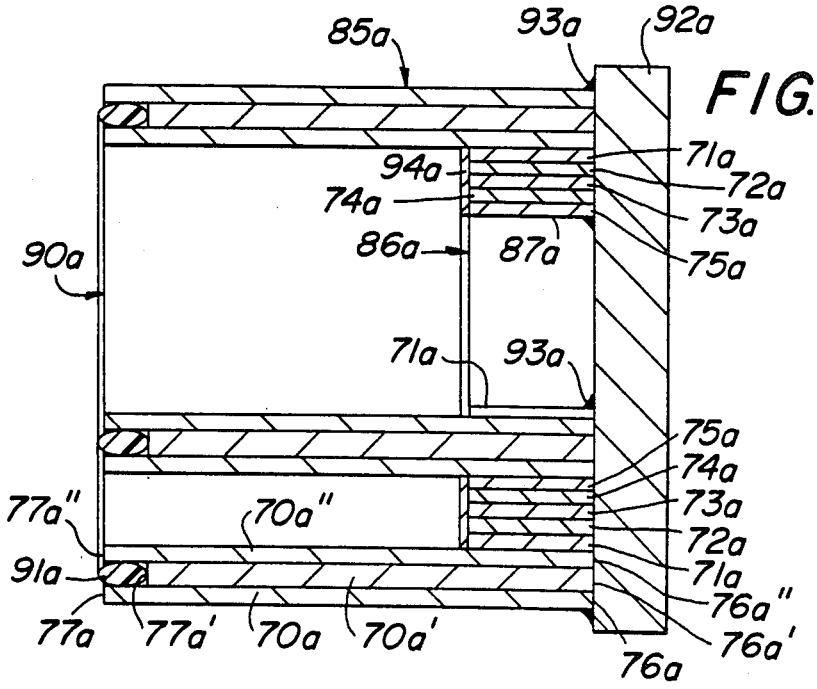
FIG. 8 is a sectional view similar to FIG. 7 but showing a slightly modified embodiment of the present invention.

For example in FIG. 8, a scroll element 85*a* is similar to the scroll element 85 including a plurality of relatively narrow laminations 71*a*, 72*a*, 73*a*, 74*a* and 75*a* spirally wound with adjacent convolutions in facing engagement with each other. Additionally there may be a plurality of relatively wide laminations 70*a*, 70*a*′, 70*a*″ in facing engagement with each other and spirally wound together with the narrow laminations. The wide laminations may have one longitudinal edge generally coplanar with each other and the outer longitudinal edges of the narrow laminations. That is, the wide laminations 70*a*, 70*a*′ and 70*a*″ may have their respective edges 76*a*, 76*a*′ and 76*a*″ generally coplanar or flush with each other and with the outer edges of the narrow laminations 71*a*, 72*a*, 73*a*, 74*a* and 75*a*. As the laminations 70a, 70*a*′ and 70*a*″ are wider than the narrow laminations, they extend beyond the latter to terminate at 77*a*, 77*a*′ and 77*a*″, beyond the narrow laminations.

Thus, it will be appreciated that the multiple laminations 70*a*, 70*a*′ and 70*a*″ define a spiral wrap, generally designated 90*a* on an end plate or wall 86*a* corresponding to the spiral wrap 90 of FIG. 7 on the end plate or wall 86.

In addition, the spiral wrap 90*a* may have its intermediate lamination 70*a*′ terminating at an edge 77*a*′ short of the edges 77*a* and 77*a*″ of laminations 70*a* and 70*a*″. In this manner, the edges 77*a*, 77*a*′ and 77*a*″ combine to define an end groove, as for receiving a sealing element 91*a* for sealing engagement with a complementary scroll element.

Also, scroll element 85*a* of FIG. 8 illustrates the central opening 87*a* as closed by a generally flat plate or wall 92*a* suitably secured by welds 93*a* to the flush or coincident edges of the several laminations. If desired, a generally flat, but spirally configured sheet or plate 94*a* may be suitably secured on the inner coincident edges of the narrower laminations 71*a*, 72*a*, 73*a*, 74*a* and 75*a*, as for bearing engagement with the seal element of a mating scroll element.

From the foregoing, it is seen that the present invention provides a scroll type fluid displacement apparatus and method of manufacture which are extremely simple and advantageous in construction and operation, and fully accomplish their intended objects.

Although the present invention has been described in some detail by way of illustration and example for purposes of clarity of understanding, it is understood that certain changes and modifications may be made within the spirit of the invention.

What is claimed is:

1. In the method of making a scroll type apparatus including a back plate and a spiral wrap on one face of said back plate, the steps which comprise: placing at least two strips of flexible material longitudinally of and in facing engagement with each other with at least one of said strips having one longitudinal edge located laterally beyond the remaining strip, and coiling said strips into a helix with adjacent convolutions in engagement with each other, whereby said coil strips combine laterally inwardly of said remaining strip to define a back plate, and said one strip laterally beyond said remaining strip defines a spiral wrap on said back plate.

2. The method according to claim 1, further characterized in securing together said coiled strips to maintain the helix.

3. The method according to claim 2, further characterized in anchoring at least one end of one of said strips to a mandrel, and wihding said strips about the mandrel to effect said coiling.

4. The method according to claim 3, further characterized in rotating the mandrel to effect said winding.

5. The method according to claim 1, further characterized in effecting said coiling by winding said strips about a mandrel.

6. The method according to claim 5, further characterized in securing together said coiled strips to maintain the helix, and removing the mandrel to leave a central through opening in the helix.

7. The method according to claim 6, further characterized in securing a closure in closing relation with said through opening.

8. The method according to claim 7, further characterized in securing a base member to said back plate in closing relation with said through opening to define said closure.

9. The method according to claim 1, further characterized in securing a base member to said back plate remote from said spiral wrap.

* * * * *